US010006400B2

(12) United States Patent
Park et al.

(10) Patent No.: US 10,006,400 B2
(45) Date of Patent: Jun. 26, 2018

(54) BLOCK INSERT AND CYLINDER STRUCTURE OF VEHICLE ENGINE INCLUDING THE SAME

(71) Applicants: HYUNDAI MOTOR COMPANY, Seoul (KR); KIA MOTORS CORPORATION, Seoul (KR)

(72) Inventors: Cheol-Soo Park, Suwon-si (KR); Bong-Hoon Han, Seoul (KR); Kwang-Min Kim, Seongnam-si (KR); Dong-Suk Chae, Seoul (KR); Min-Kyu Park, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days. days.

(21) Appl. No.: 15/247,222

(22) Filed: Aug. 25, 2016

(65) Prior Publication Data

US 2017/0159601 A1 Jun. 8, 2017

(30) Foreign Application Priority Data

Dec. 7, 2015 (KR) ..... 10-2015-0173023

(51) Int. Cl.

| | |
|---|---|
| ***F02F 1/16*** | (2006.01) |
| ***F02F 1/14*** | (2006.01) |
| *F02F 7/00* | (2006.01) |

(52) U.S. Cl.

CPC ..... *F02F 1/16* (2013.01); *F02F 1/14* (2013.01); *F02F 7/0007* (2013.01)

(58) Field of Classification Search

CPC ..... F02F 1/16; F02F 1/14; F02F 7/0007

See application file for complete search history.

(56) References Cited

U.S. PATENT DOCUMENTS

| | | | | |
|---|---|---|---|---|
| 5,474,040 | A * | 12/1995 | Murakami | F02F 1/108 123/193.2 |
| 6,883,471 | B1 | 4/2005 | Belter et al. | |
| 2005/0217615 | A1* | 10/2005 | Matsutani | F01P 3/02 123/41.74 |
| 2010/0024748 | A1* | 2/2010 | Chae | F01P 3/02 123/41.72 |

(Continued)

FOREIGN PATENT DOCUMENTS

| | | | |
|---|---|---|---|
| JP | H06-241111 | A | 8/1994 |
| JP | H10-196449 | A | 7/1998 |

(Continued)

*Primary Examiner* — Jacob Amick
*Assistant Examiner* — Charles Brauch
(74) *Attorney, Agent, or Firm* — McDermott Will & Emery LLP

(57) ABSTRACT

A cylinder structure of a vehicle engine comprises a cylinder block including: a block cooling water inlet formed on one side surface of the cylinder block and introduced with cooling water from a water pump; and a block cooling water outlet formed on a rear surface of the cylinder block and having the cooling water discharged therethrough. A cylinder disposed inside the cylinder block, and a water jacket is formed between an inner circumferential surface of the cylinder block and an outer circumferential surface of the cylinder to flow the cooling water therethrough. A block insert is inserted into a lower portion of the water jacket to guide the flow of the cooling water.

14 Claims, 11 Drawing Sheets

(56) References Cited

U.S. PATENT DOCUMENTS

| | | | | |
|---|---|---|---|---|
| 2013/0160725 | A1* | 6/2013 | Nishio | F02F 1/10<br>123/41.79 |
| 2014/0209046 | A1* | 7/2014 | Steiner | F01P 5/10<br>123/41.31 |

FOREIGN PATENT DOCUMENTS

| | | | |
|---|---|---|---|
| JP | 2005-291013 | A | 10/2005 |
| JP | 2012-237272 | A | 12/2012 |
| JP | 2014-194219 | A | 10/2014 |
| JP | 2015-190351 | A | 11/2015 |
| KR | 10-2012-0060061 | A | 6/2012 |
| KR | 10-2013-0053311 | A | 5/2013 |
| KR | 10-1327002 | B1 | 11/2013 |

* cited by examiner

BLOCK INSERT AND CYLINDER STRUCTURE OF VEHICLE ENGINE INCLUDING THE SAME

CROSS-REFERENCE TO RELATED APPLICATIONS

This application claims the benefit of priority to Korean Patent Application No. 10-2015-0173023, filed on Dec. 7, 2015, which is incorporated herein by reference in its entirety.

TECHNICAL FIELD

The present disclosure relates to a block insert and a cylinder structure of a vehicle engine including h same, and more particularly, to a block insert capable of preventing a temperature of a siamese portion of a cylinder block and a temperature of a piston top ring portion from excessively rising upon combustion and a cylinder structure of a vehicle engine including the same.

BACKGROUND

In an existing engine, a temperature of cooling water inside a cylinder head and a cylinder block are controlled by a cooling water control mechanism positioned at an engine inlet or an engine outlet. By this, the cylinder head and the cylinder block maintain the cooling water temperature. However, in order to improve fuel efficiency and performance, a variable dividing cooling technology separately controlling the cooling water in the cylinder head and the cooling water in the cylinder block has been developed recently.

During an engine operation, a piston friction loss accounts for the highest ratio among engine friction resistances. Upon increasing a temperature of a wall surface of the cylinder block to prevent piston friction, the piston friction loss decreases, and thus, fuel efficiency is improved. On the other hand, upon increasing the overall temperature of the engine to increase the temperature of the cylinder, combustion stability such as knocking becomes problem. For this reason, as a method for lowering a temperature of a head portion of a combustion chamber while maintaining the temperature of the cylinder block high, a variable dividing cooling technology for controlling the cooling water of the cylinder head and the cooling water of the cylinder block, respectively, are implemented to secure the combustion stability while achieving the improvement in fuel efficiency. That is, the block blocks a flow rate of cooling water at a medium speed or less and a heavy load or less in an engine operating area to keep the temperature high and the head side maintains the temperature as before or slightly reduces the temperature but increases a flow rate of cooling water of the block side at a high-speed, high-load operation to lower the temperature of the cylinder.

To apply the variable dividing cooling technology, a structure divide the cooling water of the cylinder head and the cooling water of the cylinder block is required, which is generally implemented to remove water holes of a head gasket. However, for this purpose, there is a need to increase the overall temperature of the cylinder block. In this case, a temperature of a siamese portion of the block and a temperature of a piston top ring portion excessively rise upon combustion, and therefore, knocking characteristic is aggravated. Further, there is a limit of increasing the temperature of the block, in a low and medium-speed, high-load area, such that the fuel efficiency may be decreased and the durability may be aggravated.

SUMMARY

An embodiment in the present disclosure is directed to a block insert capable of forming a cooling hole into which cooling water flows in a siamese portion of a cylinder block and increasing a flow velocity of the cooling water flowing into the cooling hole to increase a flow rate passing through an inside of the cooling hole and a cylinder structure of a vehicle engine including the same.

Other objects and advantages of the present disclosure can be understood by the following description, and become apparent with reference to the embodiments in the present disclosure. Further, it is obvious to those skilled in the art to which the present disclosure pertains that the objects and advantages of the present disclosure can be realized by the means as claimed and combinations thereof.

In accordance with an embodiment in the present disclosure, a cylinder structure of a vehicle engine includes a cylinder block including: a block cooling water inlet formed on one side surface of the cylinder block and introduced with cooling water from a water pump; and a block cooling water outlet formed on a rear surface of the cylinder block and having the cooling water discharged therethrough. A cylinder is disposed inside the cylinder block, and a water jacket is formed between an inner circumferential surface of the cylinder block and an outer circumferential surface of the cylinder to flow the cooling water therethrough. A block insert is inserted into a lower portion of the water jacket to guide the flow of the cooling water. The water jacket may include a first cooling water channel which is a shorter channel among channels from the block cooling water inlet to the block cooling water outlet and a second cooling water channel which is a longer channel among the channels from the block cooling water inlet to the block cooling water outlet.

The cylinder structure may be configured to include a cooling hole formed to penetrate through a siamese portion of the cylinder, from the second cooling water channel toward the first cooling water channel.

In the cooling hole, an inlet of the cooling hole formed at the second cooling water channel side may be formed to be higher than an outlet of a cooling hole formed at the first cooling water channel side.

The block insert may include: a plurality of flow resistance portion formed to have inner side surfaces contact the siamese portion; an insert support portion configured to protrude upward from an upper surface of the flow resistance portion to increase a flow velocity of cooling water inside the water jacket and guide the flow of the cooling water toward the cooling hole side; and a bridge configured to be disposed between the plurality of flow resistance portions to connect among the plurality of flow resistance portions.

An outer side surface of the insert support portion may be a surface extended upward from an outer side surface of the flow resistance portion and an inner side surface of the insert support portion may be a cylindrical outer circumference surface having a curvature.

A radios of the curvature of the inner side surface of the insert support portion may be a value to make a first width between the inner side surface of the insert support portion and the inner side surface of the flow resistance portion be 50% or less of a second width of a channel at a contact between the inner side surface of the insert support portion and the outer side surface of the flow resistance portion.

A first central point of the curvature of the inner side surface of the insert support portion may be positioned on a line connecting between a second central point of the inner side surface of the flow resistance portion and a third central point of the outer side surface of the insert support portion and a central line vertical to the first width may be disposed to be toward the second central point of the inner side surface of the flow resistance portion.

Based on the second central point of the inner side surface of the flow resistance portion, an upper left end of the inner side surface may be provided with a flow improvement groove.

The flow improvement groove may be machined from the second central point of the inner side surface of the flow resistance portion to the first width, at the same curvature as that of the inner side surface of the flow resistance portion.

A height of the flow improvement groove may be formed to be a height from the upper surface of the flow resistance portion to the outlet of the cooling hole.

In accordance with another embodiment in the present disclosure, a block insert includes: a plurality of flow resistance portions having inner side surfaces which contact a siamese portion of the cylinder; an insert support portion protruding upward from an upper surface of the flow resistance portion to increase a flow velocity of cooling water inside the water jacket and guide the flow of the cooling water toward the cooling hole side; and a bridge disposed between the plurality of flow resistance portions to connect among the plurality of flow resistance portions.

An outer side surface of the insert support portion may extend upward from an outer side surface of the flow resistance portion and an inner side surface of the insert support portion may be a cylindrical outer circumference surface having a curvature.

A radius of the curvature of the inner side surface of the insert support portion may be a value to make a first width between the inner side surface of the insert support portion and the inner side surface of the flow resistance portion be 50% or less of a second width of a channel at a contact between the inner side surface of the insert support portion and the outer side surface of the flow resistance portion.

A first central point of the curvature of the inner side surface of the insert support portion may be positioned on a line connecting between a second central point of the inner side surface of the flow resistance portion and a third central point of the outer side surface of the insert support portion and a central line vertical to the first width may be disposed to be toward the second central point of the inner side surface of the flow resistance portion.

Based on the second central point of the inner side surface of the flow resistance portion, an upper left end of the inner side surface may be provided with a flow improvement groove.

The flow improvement groove may be machined from the second central point of the inner side surface of the flow resistance portion to the first width, at the same curvature as that of the inner side surface of the flow resistance portion.

A height of the flow improvement groove may be formed to be a height from the upper surface of the flow resistance portion to the outlet of the cooling hole.

DETAILED DESCRIPTION OF SPECIFIC EMBODIMENTS

Terms and words used in the present specification and claims are not to be construed as a general or dictionary meaning but are to be construed meaning and concepts meeting the technical ideas of the present invention based on a principle that the inventors can appropriately define the concepts of terms in order to describe their own inventions in best mode. Therefore, the configurations described in the exemplary embodiments and drawings of the present disclosure are merely exemplary embodiments but do not represent all of the technical spirit of the present disclosure. Thus, the present disclosure should be construed as including all the changes, equivalents, and substitutions included in the spirit and scope of the present disclosure at the time of filing this application. In the present specification, an overlapped description and a detailed description for well-known functions and configurations that may obscure the gist of the present disclosure will be omitted. Hereinafter, exemplary embodiments in the present disclosure will be described in detail with reference to the accompanying drawings.

Figure 1:
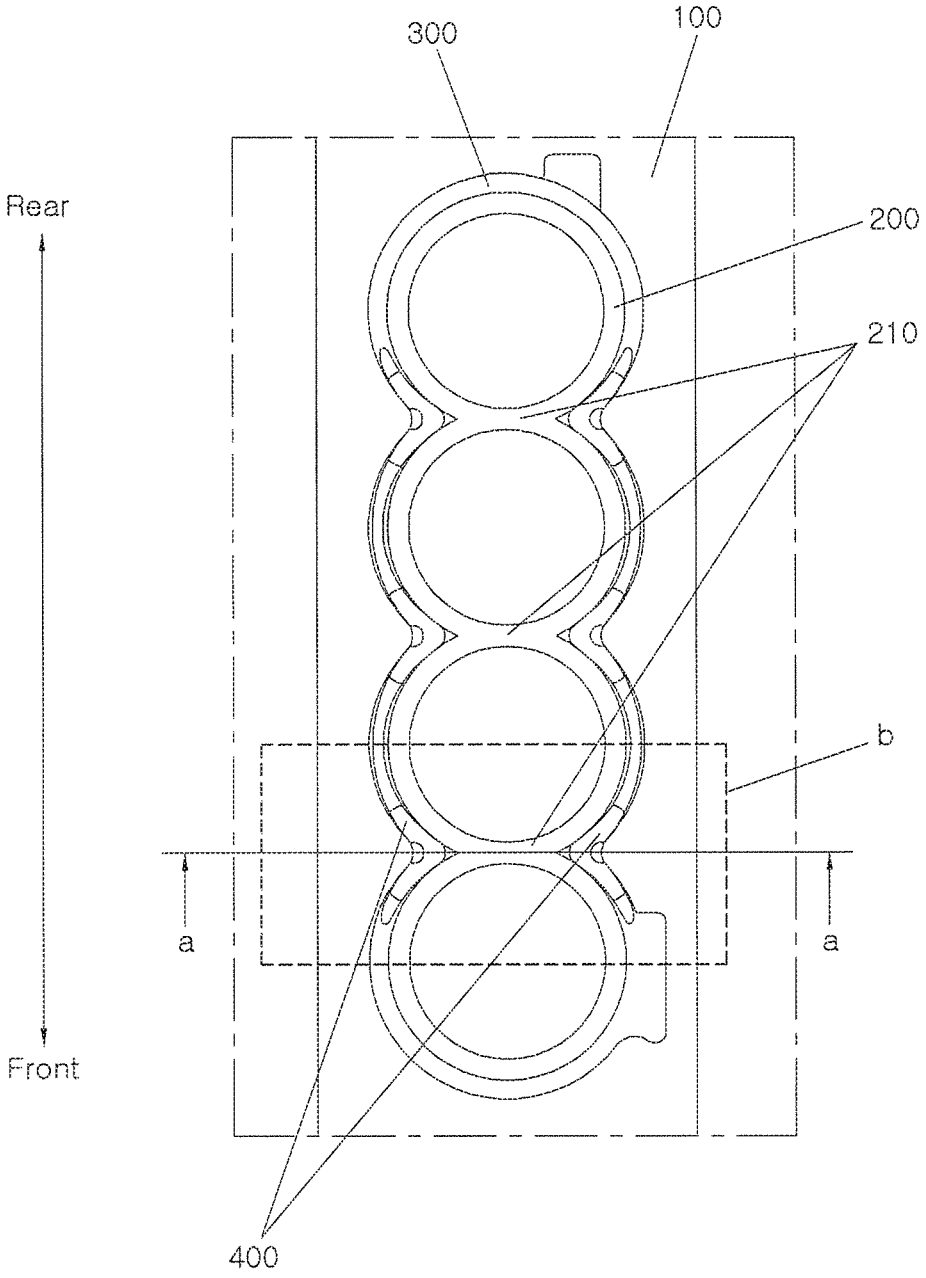
FIGS. 1 and 2 are plan views of a cylinder structure of a vehicle engine according to an exemplary embodiment of the present disclosure.
Figure 2:
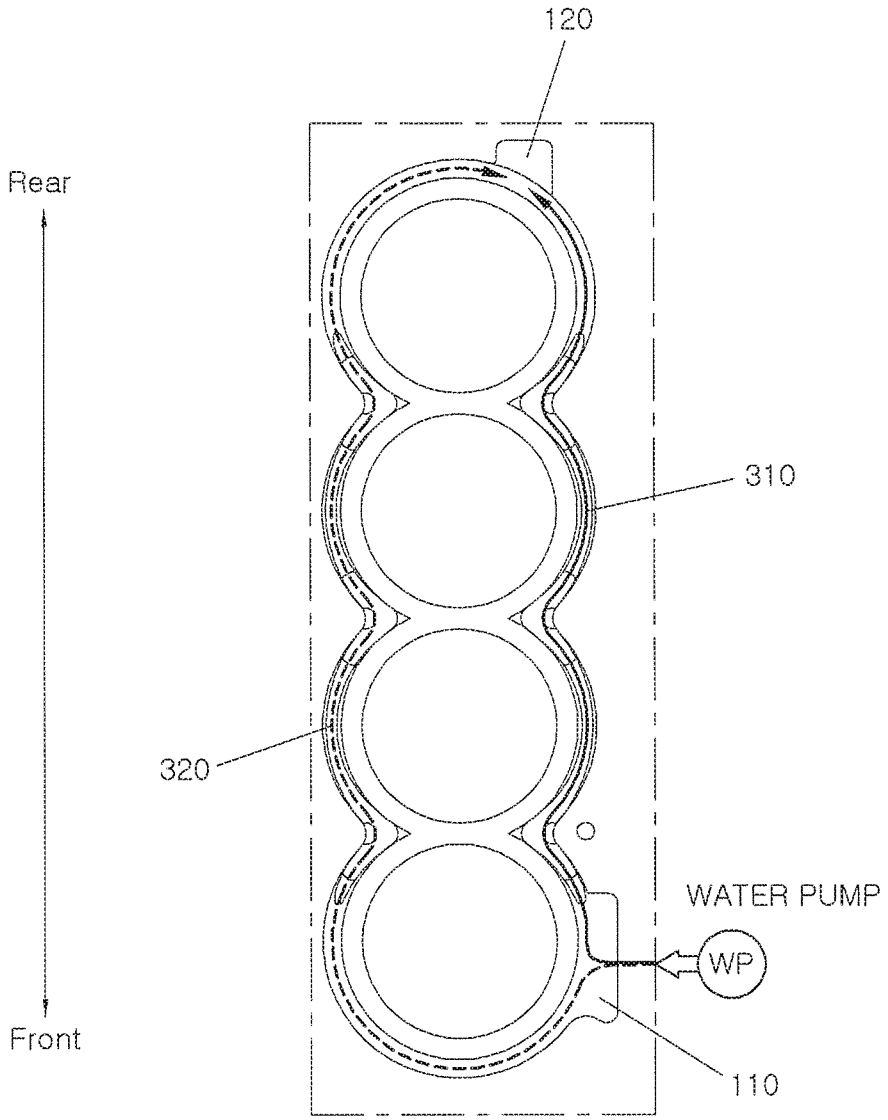
Figure 3:
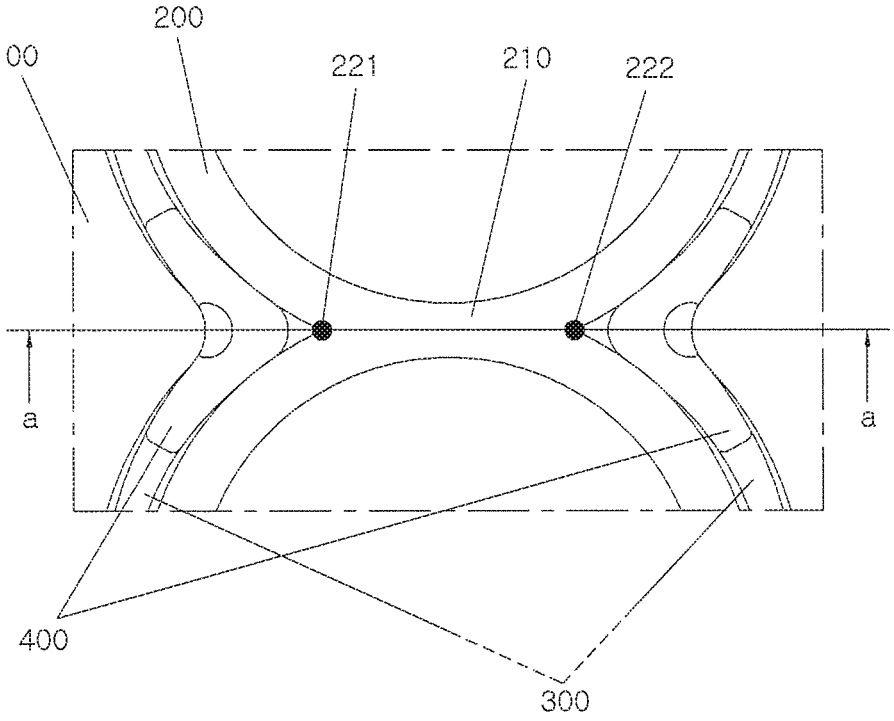
FIG. 3 is an enlarged view of part b of FIG. 1.
Figure 4:
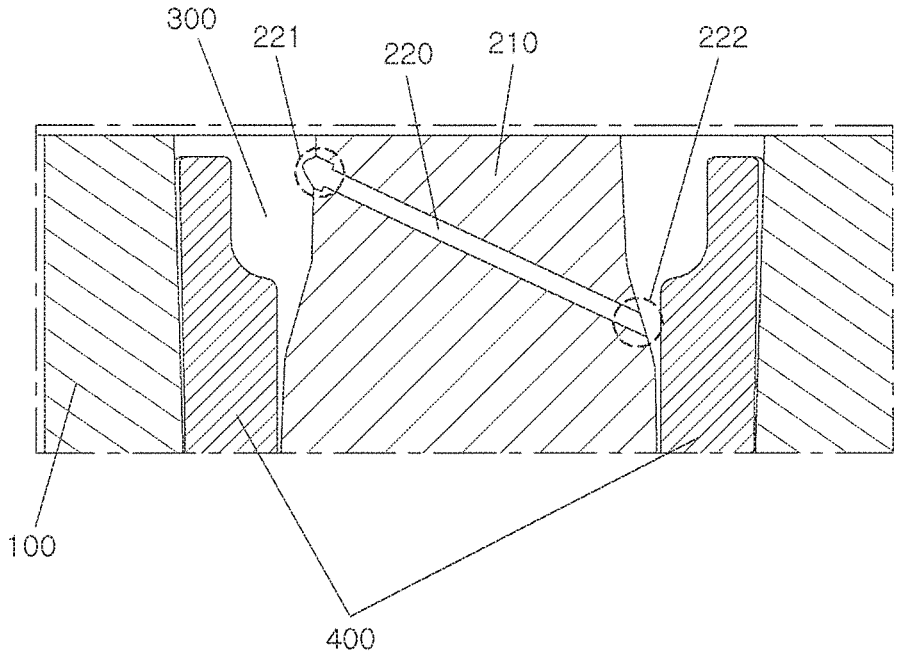
FIG. 4 is a cross-sectional view taken along the line a-a of FIG. 3.
Figure 5:
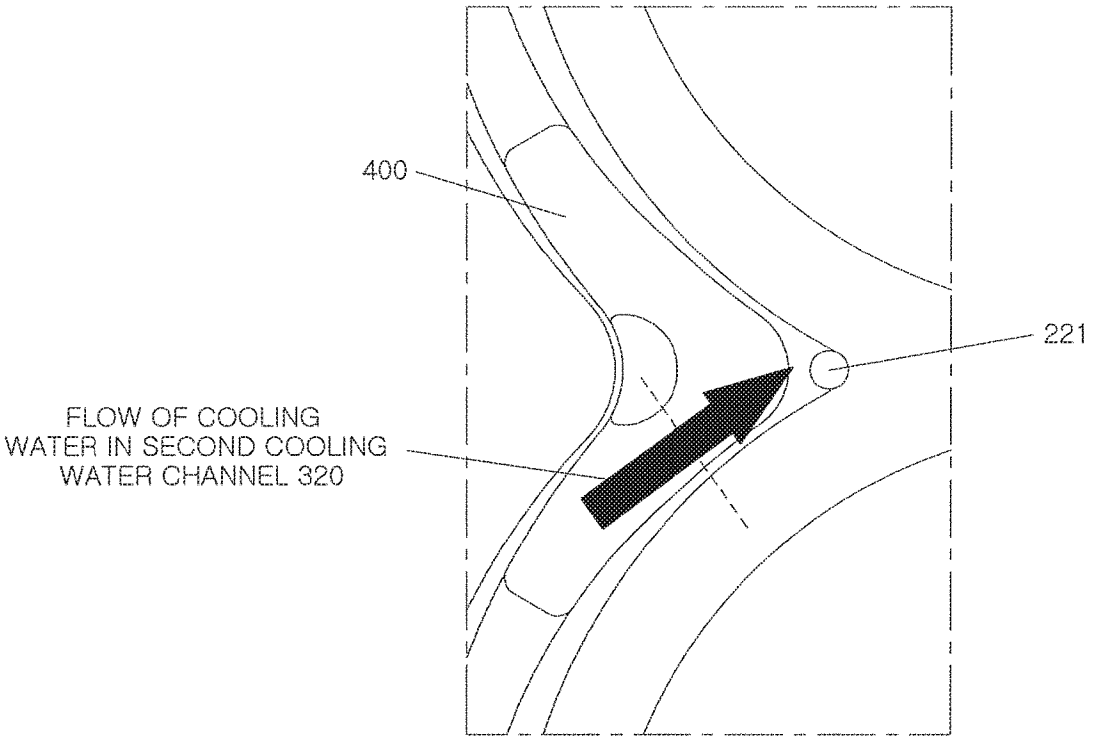
FIG. 5 is a diagram for describing a flow of cooling water in a second cooling water channel according to an exemplary embodiment in the present disclosure.
Figure 6:
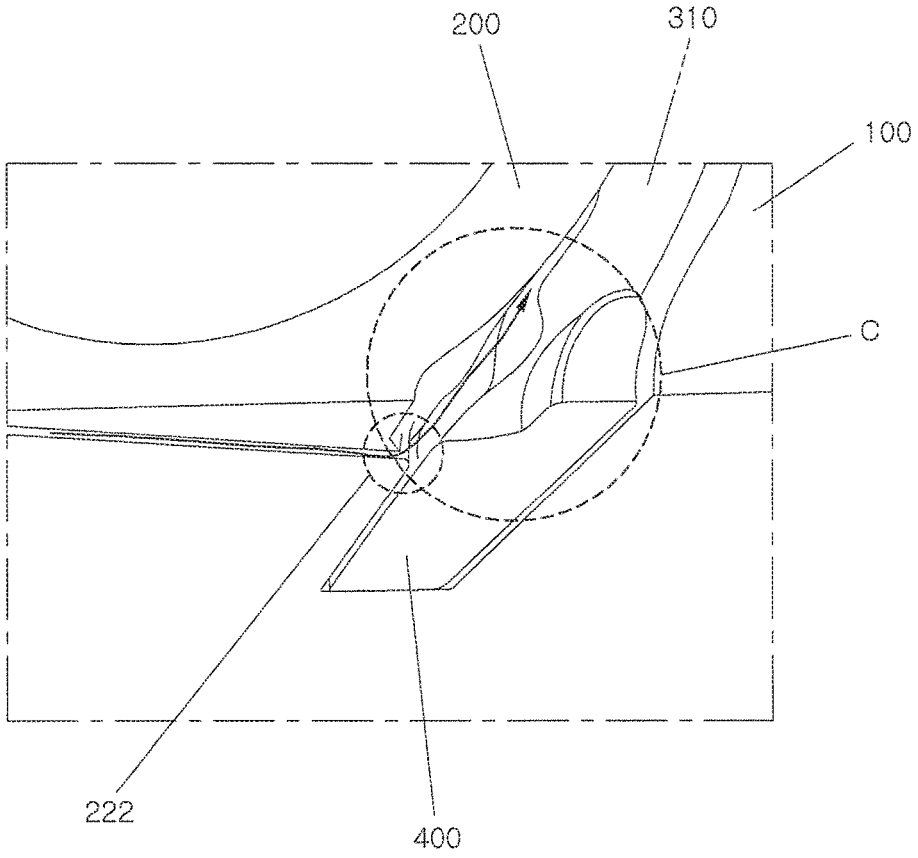
FIG. 6 is a diagram for describing a flow of cooling water in a cooling hole according to an exemplary embodiment in the present disclosure.

FIGS. 1 and 2 are plan views of a cylinder structure of a vehicle engine according to an exemplary embodiment in the present disclosure. FIG. 3 is an enlarged view of part b of FIG. 1, and FIG. 4 is a cross-sectional view taken along the line a-a of FIG. 3. FIG. 5 is a diagram for describing a flow of cooling water in a second cooling water channel according to an exemplary embodiment in the present disclosure, and FIG. 6 is a diagram for describing a flow of cooling water in a cooling hole according to an exemplary embodiment in the present disclosure.

Referring to FIGS. 1 to 6, a cylinder structure of a vehicle engine according to the present disclosure may include a cylinder block 100, a cylinder 200, a water jacket 300, and a block insert 400 (see FIG. 1).

The cylinder block 100 is a part configuring a framework of an engine and an inside thereof is provided with the cylinder 200, the water jacket 300, the block insert 400, etc. Further, the cylinder block 100 has a block cooling water inlet 110 and a block cooling water outlet 120. The block cooling water inlet 110 is formed on one side surface of the cylinder block 100 and is a point introduced with cooling water from a water pump. Further, the block cooling water outlet 120 is formed on a rear surface of the cylinder block 100 and is a point at which the cooling water is discharged FIG. 2).

The cylinder 200 is disposed inside the cylinder block 100 and provided with a plurality of cylinder bores. A piston reciprocates inside the cylinder 200 to generate power of a vehicle. Further, a siamese portion 210 is formed between the cylinder bores and a cooling hole 220 is formed to penetrate through the siamese portion 210 (see FIGS. 3 and 4).

The water, jacket 300 is formed between an inner circumferential surface of the cylinder block 100 and an outer circumferential surface of the cylinder 200 to serve as a passage through which the cooling water flows. The water jacket include a first cooling water channel 310 which is a short channel among channels from the block cooling water inlet 110 to the block cooling water outlet 120 and a second cooling water channel 320 which is a long channel among the channels from the block cooling water inlet 110 to the block cooling water outlet 120. That is, the cooling water flowing in the cylinder block 100 is supplied from the water pump to the block cooling water inlet 110 and then flows into the first cooling water channel 310 and the second cooling water channel 320, respectively. Next, the cooling water meets the block cooling water outlet 120 and then is discharged outside the engine. In this case, due to a difference in length of the channels, a flow rate of the cooling water flowing into the second cooling water channel 320 is larger than that of the cooling water inside the first cooling water channel. Therefore, if the cooling hole 220 is formed to penetrate through the siamese portion 210, a flow direction of the cooling water inside the cooling hole 220 is from the second cooling water channel 320 toward the first cooling water channel 310 (see FIGS. 2 and 4).

Therefore, to increase a flow velocity and a flow rate of the cooling water flowing into the cooling hole 220, the cooling hole 220 is formed to penetrate through the siamese portion 210 of the cylinder 200, from the second cooling water channel 320 toward the first cooling water channel 310. Further, in the cooling hole 220, an inlet 221 of the cooling hole 220 formed at the second cooling water channel 320 side may be formed to be higher than an outlet 222 of the cooling hole 220 formed at the first cooling water channel 310 side (see FIGS. 5 and 6).

A block insert 400 is inserted into a lower portion of the water jacket 300 to guide the flow of the cooling water. A detailed description of the block insert 400 will be provided below.

Figure 7:
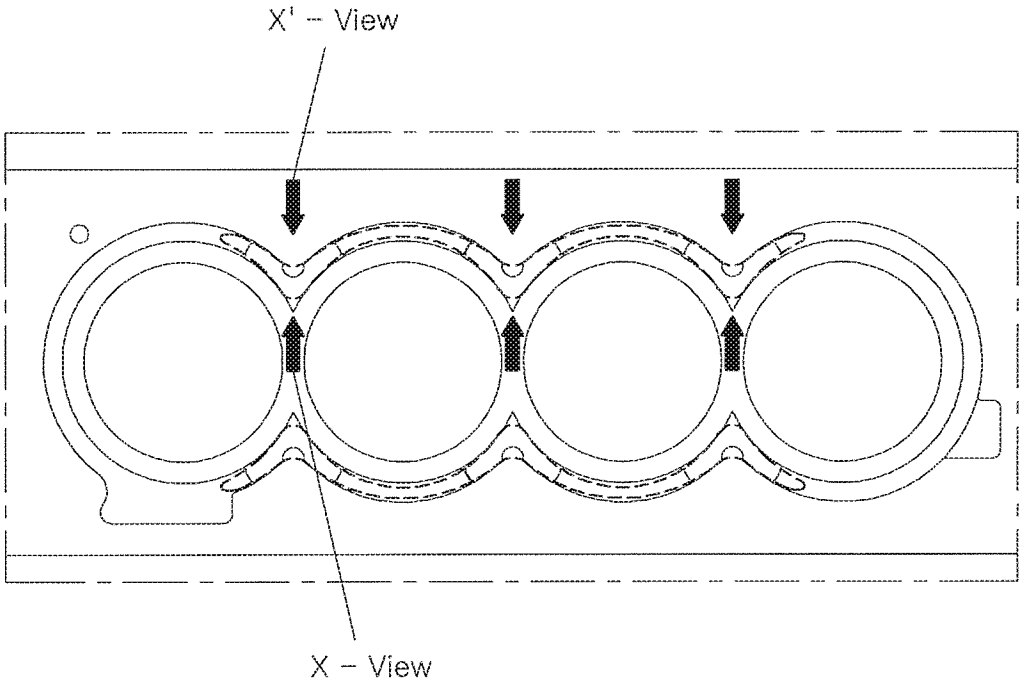
FIG. 7 is a disposition diagram of a block insert according to an exemplary embodiment in the present disclosure.
Figure 8:
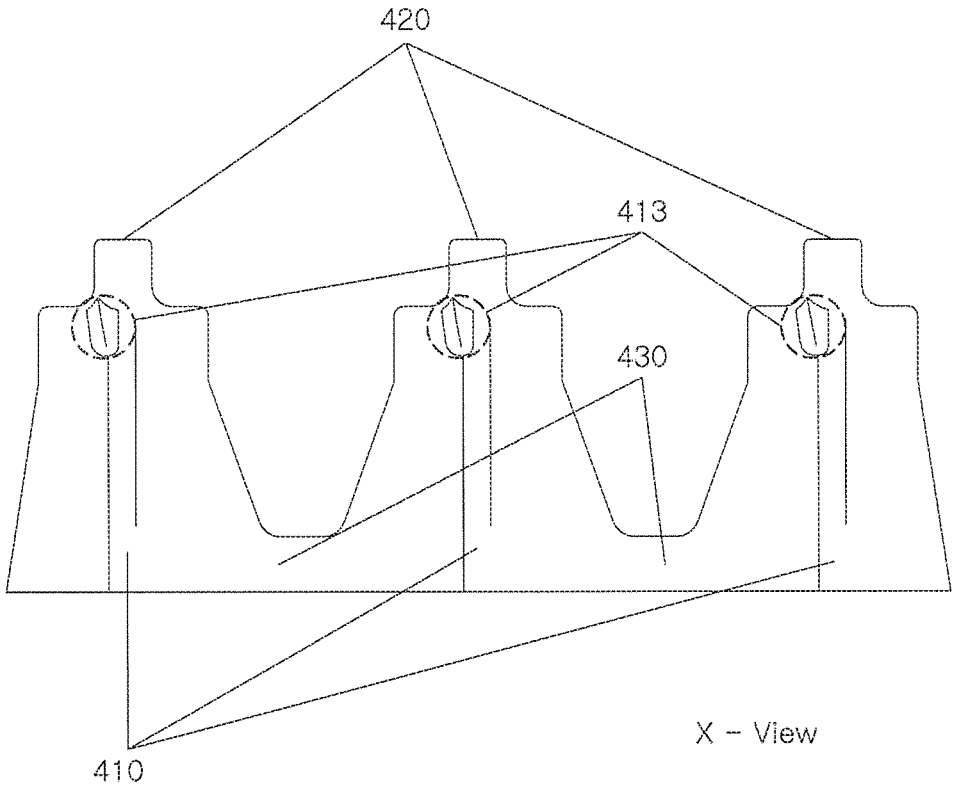
FIG. 8 is a front diagram of the block insert according to the exemplary embodiment in the present disclosure.
Figure 11:
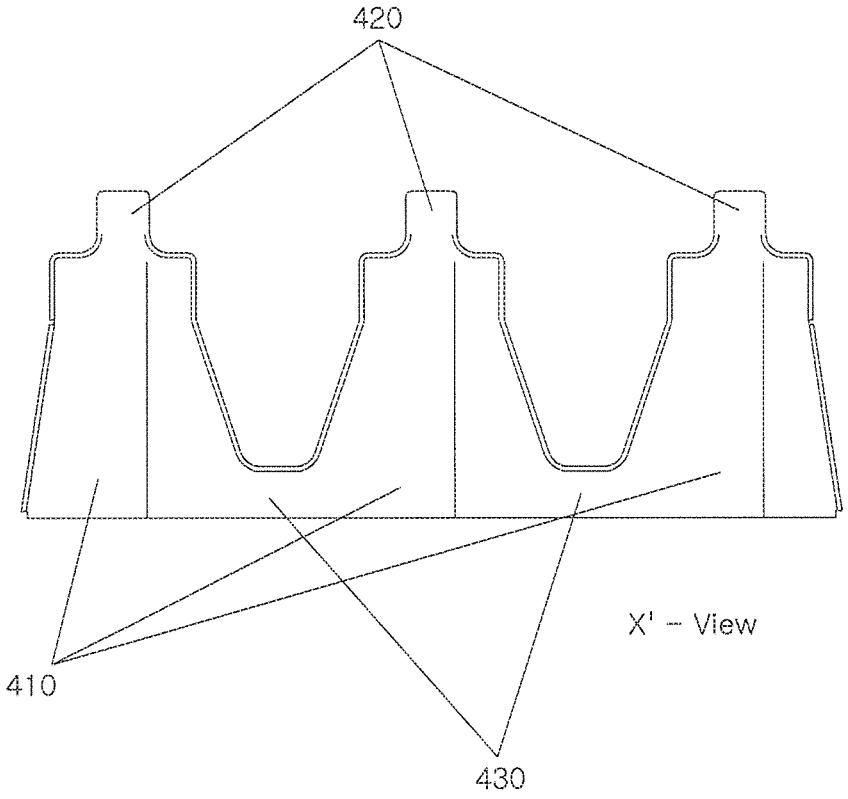
FIG. 11 is a rear diagram of the block insert according to the exemplary embodiment in the present disclosure.

FIG. 7 is a disposition diagram of a block insert according to an exemplary embodiment in the present disclosure, FIG. 8 is a front diagram of the block insert according to the exemplary embodiment in the present disclosure, and FIG. 11 is a rear diagram of the block insert according to the exemplary embodiment in the present disclosure. Referring to FIGS. 7, 8, and 11, the block insert according to the present disclosure includes a flow resistance portion 410, an insert support portion 420, and a bridge 430.

The flow resistance portion 410 is formed to have the inner side surface contact the siamese portion 210 and may be formed in plural. For example, as illustrated in FIG. 8, three flow resistance portions 410 may also be formed, but are not necessarily limited thereto. Therefore, the number of flow resistance portions 410 may be different depending on the number of cylinders of the engine.

The insert support portion 420 protrudes upward from an upper surface of the flow resistance portion 410. The insert support portion 420 supports the block insert 400 to prevent the block insert 400 from moving inside the water jacket 300. Simultaneously, the insert support portion 420 makes a width of the channel inside the water jacket 300 narrow to serve to increase the flow velocity of the cooling water inside the water jacket 300 and guide the flow of the cooling water to the cooling hole 220 side. Therefore, the insert support portion 420 increases the flow velocity and the flow rate of the cooling water passing through the inside of the cooling hole 220. For this, a detailed structure of the insert support portion 420 will be described below.

A bridge 430 may be disposed between the plurality of flow resistance portions 410 to connect among the plurality of flow resistance portions 410.

Figure 9:
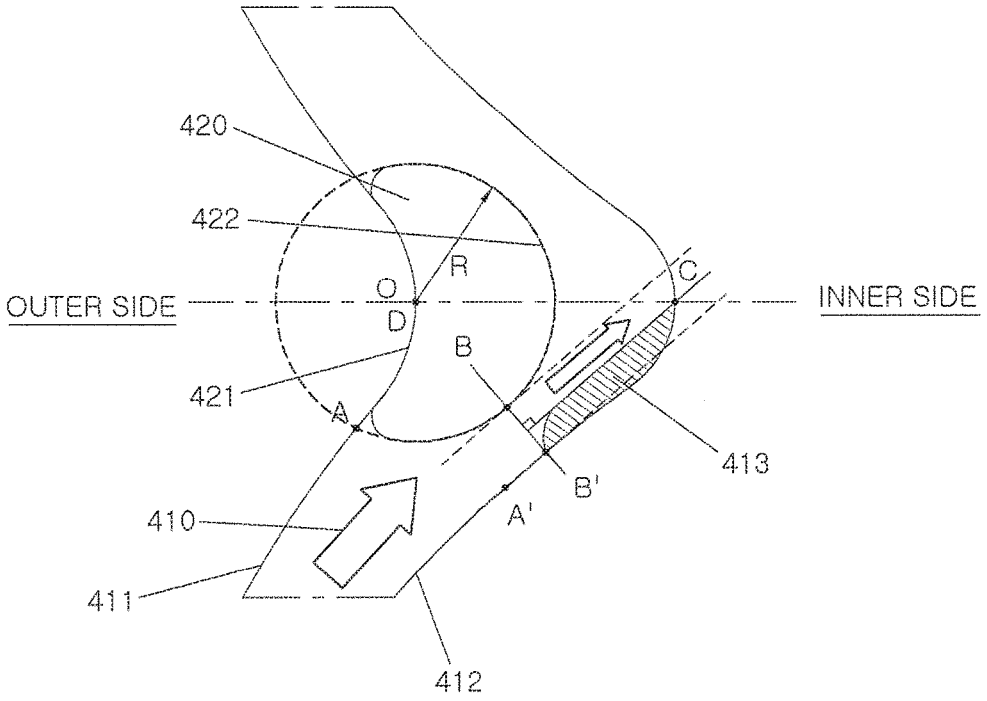
FIGS. 9 and 10 are plan enlarged views of the block insert according to the exemplary embodiment in the present disclosure.

FIG. 9 is a plan enlarged view of the block insert according to the exemplary embodiment in the present disclosure. Referring to FIG. 9, an outer side surface 421 of the insert support portion 420 is a surface extending upward from an outer side surface 411 of the flow resistance portion 410, and an inner side surface 422 of the insert support portion 420 is a cylindrical outer circumference surface having a curvature radius of R. That is, the outer side surface 421 is formed as a surface extending upward from the outer side surface 411 of the flow resistance portion 410 to contact the inner circumferential surface of the cylinder block 100. Further, the inner side surface 421 is formed as the cylindrical outer circumferential surface having the curvature radius of R to minimize a resistance applied to the cooling water flowing into the water jacket 300 so as to increase the flow velocity of the cooling water.

The curvature radius R of the inner side surface of the insert support portion 420 is a value to make a minimum width $\overline{BB'}$ between the inner side surface 422 of the insert support portion 420 and the inner side surface 410 of the flow resistance portion 410 be 50% or less of a width $\overline{AA'}$ of a channel at a contact A between the inner side surface 422 of the insert support portion 420 and the outer side surface 411 of the flow resistance portion 410. This narrows the width of the channel inside the water jacket 300 to increase the flow velocity of the cooling water.

A central point O of the curvature radius R of the inner side surface of the insert support portion 420 is positioned on a line connecting between a central point C of the inner side surface 412 of the flow resistance portion 410 and a central point D of the outer side surface 421 of the insert support portion 420, and a central line vertical to the minimum width $\overline{BB'}$ is disposed to be toward the central point C of the inner side surface 412 of the flow resistance portion 410. Thus, a flow direction of the cooling water passing through the channel narrowed by the insert support part 420 is toward the inlet 221 of the cooling hole 220. Therefore, the flow rate and the flow velocity of the cooling water passing through the cooling hole 220 are increased.

Figure 10:
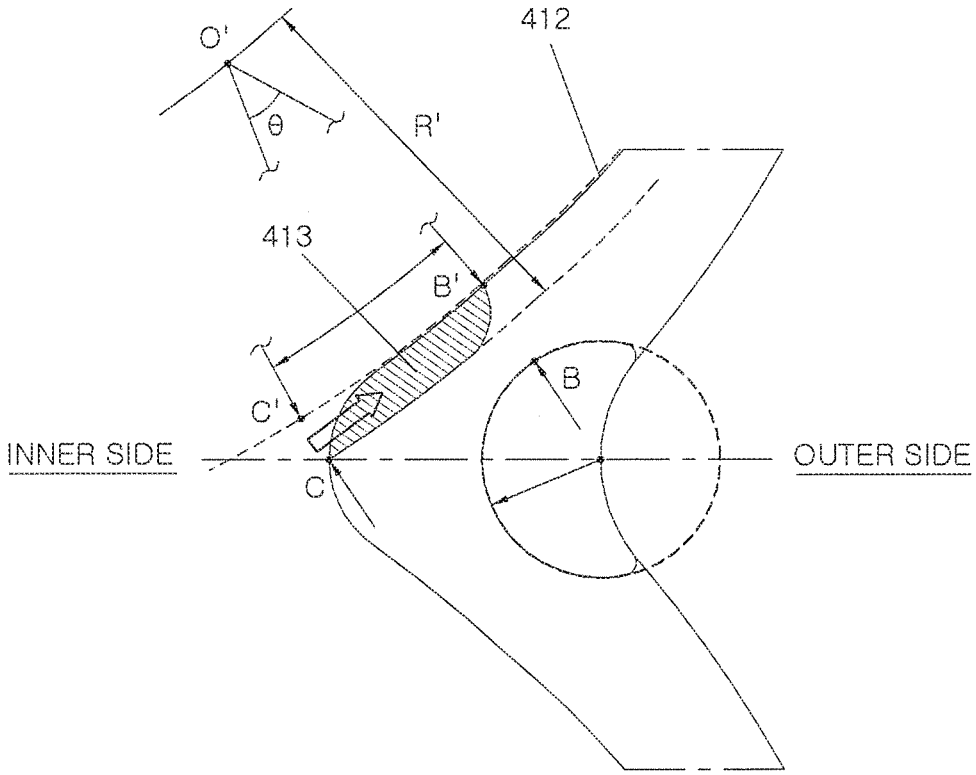

FIG. 10 is a plan enlarged view of the block insert according to the exemplary embodiment in the present disclosure. Referring to FIG. 10, based on the central point C of the inner side surface 412 of the flow resistance portion 410, an upper left end of the inner side surface 412 is provided with a flow improvement groove 413. That is, to increase the flow rate and the flow velocity of the cooling water passing through the cooling hole 220, as illustrated in FIG. 4, in the cooling hole 220, the inlet 221 of the cooling hole 220 formed at the second cooling water channel 320 side is formed to be higher than the outlet 222 of the cooling hole 220 formed at the first cooling water channel 310 side, from the second cooling water channel 320 toward the first cooling water channel 310. However, the flow resistance portion 410 of the block insert 400 facing the outlet 222 of the cooling hole 220 may act as the resistance to decrease the flow rate and the flow velocity of the cooling water inside the cooling hole 220. Therefore, as described above, the flow resistance portion 410 of the block insert 400 facing the outlet 222 of the cooling hole 220 is provided with the flow improvement groove 413 to prevent the decrease in the flow rate and the flow velocity of the cooling water. Hereinafter, the flow improvement groove 413 will be described in detail.

The flow improvement groove 413 is machined from the central point C of the inner side surface 412 of the flow resistance portion 410 to the minimum width $\overline{BB'}$, at the same curvature as that of the inner side surface 412 of the flow resistance portion 410. Further, the height of the flow improvement groove 413 may be a height from the upper surface of the flow resistance portion 410 to the outlet 222 of the cooling hole 220.

That is, referring to FIG. 10, upon forming a virtual arch using a length from a central point O' of the curvature of the inner side surface 412 of the flow resistance portion 410 to the central point C of the inner side surface 412 of the flow resistance portion 410 as a curvature radius R', the flow improvement groove 412 is machined from the central point C of the virtual arch to the minimum width $\overline{BB'}$, at the same curvature as that of the inner side surface 412 of the flow resistance portion 410. However, the present disclosure is not necessarily limited to the machining, and therefore, the flow improvement groove 413 may also be formed by other methods to have the area as described above.

Further, the height of the flow improvement groove 413 is formed at the height from the upper surface of the flow resistance portion 410 to the outlet 222 of the cooling hole 220 to prevent the flow resistance portion 410 from acting as the resistance against the flow of the cooling water discharged from the outlet 222 of the cooling hole 220.

As described above, according to the present disclosure, it is possible to prevent the temperature of the siamese portion and the temperature of the piston top ring portion from excessively rising upon combustion.

Therefore, the knocking characteristic may be strengthened in the low and medium-speed, high-load area.

Further, it is possible to improve the durability while improving the fuel efficiency by controlling the temperature of the cylinder block to be increased.

The foregoing exemplary embodiments are only examples to allow a person having ordinary skill in the art to which the present disclosure pertains (hereinafter, referred to as those skilled in the art) to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications, and variations can be made without departing from the spirit and scope of the invention as defined by the appended claims and can also belong to the scope of the invention.

What is claimed is:

1. A cylinder structure of a vehicle engine, comprising:

a cylinder block including:

a block cooling water inlet introduced with cooling water from a water pump at one side surface of the cylinder block; and a block cooling water outlet having the cooling water discharged therethrough at a rear surface of the cylinder block;

a cylinder disposed inside the cylinder block;

a water jacket disposed between an inner circumferential surface of the cylinder block and an outer circumferential surface of the cylinder to flow the cooling water therethrough; and a block insert inserted into a lower portion of the water jacket to guide the flow of the cooling water, wherein the water jacket includes a first cooling water channel which is a shorter channel among channels from the block cooling water inlet to the block cooling water outlet and a second cooling water channel which is a longer channel among the channels from the block cooling water inlet to the block cooling water outlet, wherein the cylinder structure further comprises a cooling hole penetrating through a siamese portion of the cylinder, from the second cooling water channel toward the first cooling water channel, wherein the cooling hole includes an inlet at the second cooling water channel and an outlet at the first cooling water channel, the inlet of the cooling hole being located higher than the outlet of the cooling hole in a gravitational direction, wherein the block insert includes:

a plurality of flow resistance portions having inner side surfaces which contact the siamese portion;

an insert support portion protruding upward from an upper surface of each of the plurality of flow resistance portions to increase a flow velocity of the cooling water inside the water jacket and guiding the flow of the cooling water toward the inlet of the cooling hole; and a bridge disposed between the plurality of flow resistance portions to connect the plurality of flow resistance portions to each other, wherein each of the flow resistance portions, facing the outlet of the cooling hole, has a flow improvement groove to prevent decrease in a flow rate and a flow velocity of the cooling water inside the cooling hole.

2. The cylinder structure of claim 1, wherein an outer side surface of the insert support portion extends upward from an outer side surface of each of the plurality of flow resistance portions, and an inner side surface of the insert support portion is a cylindrical outer circumference surface having a curvature.

3. The cylinder structure of claim 2, wherein a radius of the curvature of the inner side surface of the insert support portion determines a first width between the inner side surface of the insert support portion and the inner side surface of each of the plurality of flow resistance portions to be 50% or less of a second width of a channel at a contact between the inner side surface of the insert support portion and the outer side surface of each of the plurality of flow resistance portions.

4. The cylinder structure of claim 3, wherein a first central point of the curvature of the inner side surface of the insert support portion is positioned on a line connecting between a second central point of the inner side surface of each of the plurality of flow resistance portions and a third central point of the outer side surface of the insert support portion, and a central line vertical to the first width is disposed to be toward the second central point of the inner side surface of each of the plurality of flow resistance portions.

5. The cylinder structure of claim 4, wherein an upper left end of the inner side surface, based on the second central point of the inner side surface of each of the plurality of flow resistance portions, has the flow improvement groove.

6. The cylinder structure of claim 5, wherein the flow improvement groove is machined from the second central point of the inner side surface of each of the plurality of flow resistance portions to the first width, at the same curvature as that of the inner side surface of each of the plurality of flow resistance portions.

7. The cylinder structure of claim 5, wherein a height of the flow improvement groove is formed from the upper surface of each of the plurality of flow resistance portions to the outlet of the cooling hole.

8. A block insert mounted in a water jacket located between a cylinder block and a cylinder, wherein the cylinder block includes:

a block cooling water inlet introduced with cooling water from a water pump at one side surface of the cylinder block; and a block cooling water outlet having the cooling water discharged therethrough at a rear surface of the cylinder block and, wherein the cylinder is disposed inside the cylinder block, wherein a water jacket is disposed between an inner circumferential surface of the cylinder block and an outer circumferential surface of the cylinder to flow the cooling water therethrough, wherein the block insert is inserted into a lower portion of the water jacket to guide the flow of the cooling water, wherein the water jacket includes a first cooling water channel which is a shorter channel among channels from the block cooling water inlet to the block cooling water outlet and a second cooling water channel which is a longer channel among the channels from the block cooling water inlet to the block cooling water outlet, wherein the cylinder structure further comprises a cooling hole penetrating through a siamese portion of the cylinder, from the second cooling water channel toward the first cooling water channel, wherein the cooling hole includes an inlet at the second cooling water channel and an outlet at the first cooling water channel, the inlet of the cooling hole is located higher than the outlet of the cooling hole in a gravitational direction wherein the block insert includes:

a plurality of flow resistance portions having inner side surfaces which contact the siamese portion;

an insert support portion protruding upward from an upper surface of each of the plurality of flow resistance portions to increase a flow velocity of the cooling water inside the water jacket and guiding the flow of the cooling water toward the inlet of the cooling hole; and a bridge disposed between the plurality of flow resistance portions to connect the plurality of flow resistance portions to each other, and wherein each of the flow resistance portions, facing the outlet of the cooling hole, has a flow improvement groove to prevent decrease in a flow rate and a flow velocity of the cooling water inside the cooling hole.

9. The block insert of claim 8, wherein an outer side surface of the insert support portion extends upward from an outer side surface of each of the plurality of flow resistance portions and an inner side surface of the insert support portion is a cylindrical outer circumference surface having a curvature.

10. The block insert of claim 9, wherein a radius of the curvature of the inner side surface of the insert support portion determines a first width between the inner side surface of the insert support portion and the inner side surface of each of the plurality of flow resistance portions to be 50% or less of a second width of a channel at a contact between the inner side surface of the insert support portion and the outer side surface of each of the plurality of flow resistance portions.

11. The block insert of claim 10, wherein a first central point of the curvature of the inner side surface of the insert support portion is positioned on a line connecting between a second central point of the inner side surface of each of the plurality of flow resistance portions and a third central point of the outer side surface of the insert support portion, and a central line vertical to the first width is disposed to be toward the central point of the inner side surface of each of the plurality of flow resistance portions.

12. The block insert of claim 11, wherein an upper left end of the inner side surface, based on the second central point of the inner side surface of each of the plurality of flow resistance portions, has the flow improvement groove.

13. The block insert of claim 12, wherein the flow improvement groove is machined from the second central point of the inner side surface of each of the plurality of flow resistance portions to the first width, at the same curvature as that of the inner side surface of each of the plurality of flow resistance portions.

14. The block insert of claim 12, wherein a height of the flow improvement groove is formed from the upper surface of each of the plurality of flow resistance portions to an outlet of the cooling hole.

* * * * *